United States Patent [19]

Head

[11] Patent Number: 5,058,454

[45] Date of Patent: Oct. 22, 1991

[54] POLISHED ROD SPACER SYSTEM

[76] Inventor: Harold W. Head, 213 E. 3rd, Cameron, Tex. 76520

[21] Appl. No.: 405,567

[22] Filed: Sep. 11, 1989

[51] Int. Cl.[5] ..... E21B 12/00

[52] U.S. Cl. ..... 74/586; 248/74.1

[58] Field of Search ..... 74/586; 248/55, 65, 248/74.1

[56] References Cited

U.S. PATENT DOCUMENTS

| | | | |
|---|---|---|---|
| 466,638 | 1/1892 | Turton | 74/586 |
| 531,264 | 12/1894 | Kennedy | 74/586 |
| 787,621 | 4/1905 | Graham | 74/586 |
| 968,181 | 8/1910 | Moore | 74/586 |
| 2,351,576 | 6/1944 | Thigpen | 417/313 |
| 2,877,652 | 3/1959 | Muschalek | 74/41 |
| 2,891,296 | 6/1959 | Darde | 248/74.1 |
| 2,920,500 | 1/1960 | Edman | 74/586 |
| 2,931,247 | 4/1960 | Hagar | 74/586 |
| 3,051,237 | 8/1962 | Iles, Jr. et al. | 166/97.5 |
| 3,251,310 | 5/1966 | Wittwer et al. | 417/53 |
| 3,367,279 | 2/1968 | Crowe | 417/554 |
| 3,376,826 | 4/1968 | Crowe | 417/554 |
| 4,286,656 | 9/1981 | Felder | 74/586 |
| 4,296,678 | 10/1981 | Felder | 92/13.1 |
| 4,498,845 | 2/1985 | Pittman et al. | 417/545 |
| 4,653,383 | 3/1987 | Henderson | 92/13.1 |
| 4,744,535 | 5/1988 | Patenaude | 248/74.1 |

FOREIGN PATENT DOCUMENTS

| | | | |
|---|---|---|---|
| 52-71692 | 6/1977 | Japan | 248/74.1 |

*Primary Examiner*—Leslie A. Braun
*Assistant Examiner*—Scott Anchell
*Attorney, Agent, or Firm*—Mark A. Oathout; John R. Kirk, Jr.

[57] ABSTRACT

The present invention is directed to a light weight spacer for changing the stroke of the polished rod of a sub-surface oil well pump. The spacer is made from a light weight alloy such as an aluminum alloy and is configured as a U-shaped body with a plurality of spines or ribs which have tips defining a diameter which will surround the polished rod. The spacer has an opening in one of the spines so that an extendable wand or spacer handling tool may be used to carry the spacer from the ground to be inserted or positioned between the bridal block and the upper polished rod clamp or to remove the spacer. A detent pin is used to enable the person on the ground to know that the spacer is in position and the spacer handling tool is used to close the pin or open the pin.

A jack may be included within the system of the present invention to raise the polished rod for insertion or the removal of one or more spacers.

12 Claims, 2 Drawing Sheets

POLISHED ROD SPACER SYSTEM

FIELD OF THE INVENTION

The present invention is directed to a polished rod spacer system. More specifically, the present invention is directed to a spacer used on the polished rod of an oil well pumping unit which is easily positioned by a person from the ground placing the spacer between the bridal block and upper polished rod clamp. A jack for raising the polished rod for the insertion or removal of one or more spacers may also be included in the system.

BACKGROUND OF THE INVENTION

The greatest problem associated with reciprocating pumps located in oil wells is due to sand or debris collecting in the pump valves and the jarring of the pump to clear the debris is disclosed in U.S. Pat. No. 2,351,576 of Thigpin. This patent discloses the use of a spacer member 20 which is positioned above the cross-head and which may be pivotally mounted to be positioned between the upper surface of the cross-head 10 and clamp 15 attached to the polished rod 11 to assist in carrying out the "bumping procedure" to clear the pump valves. As disclosed in U.S. Pat. No. 2,351,576, accumulation of sand or other debris hinders the operation of the reciprocating pump, particularly the valves therein, and rather than removing the sucker rod string and the pump from the well for cleaning and adjustment, the string is jarred in a procedure commonly referred to as "tagging bottom". The disclosure in the Thigpen patent, referred to as a "bumping" procedure, is the same "tagging bottom" procedure for jarring the pump, especially the valves in the reciprocating pump located in the well.

Spacers have been used for other purposes when located between the upper surface of a bridal head and a clamp attached to a polished rod such as disclosed in U.S. Pat. No. 3,251,310. In this patent a spacer is used so that a dynamometer may be inserted between the upper surface of the carrier bar and the clamp on the polished rod.

U.S. Pat. Nos. 2,877,652; 4,296,678; and 4,653,383 all disclose hydraulic cylinders which change or increase the stroke of the polished rod normally raised and lowered by a connector cable of an oscillating horse head for operating a sub-surface oil well pump. Each of these patents disclose an extensive and expensive system to change the stroke of the polished rod.

All of these patents require extensive or expensive equipment, such as a hydraulic system to make the change in the stroke of the polished rod, or that the person making the change be subject to the danger of a fall or being hurt by the equipment since the change must be done at a significant height so that the person must make the change off the ground. In the system of the present invention, the use of a spacer which may be easily inserted or removed by a person standing on the ground overcomes the dangers of the prior art and permits the light weight spacers, which is a feature of the present invention, to be quickly and easily used.

SUMMARY OF THE INVENTION

The present invention is directed to a light weight spacer for changing the stroke of the polished rod of a sub-surface oil well pump. The spacer is made from a light weight alloy such as an aluminum alloy and is configured as a U-shaped body with a plurality of spines or ribs which have tips defining a diameter which will surround the polished rod. The spacer has an opening in one of the spines so that an extendable wand or spacer handling tool may be used to carry the spacer from the ground to be inserted or positioned between the bridal block and the upper polished rod clamp or to remove the spacer. A detent pin is used to enable the person on the ground to know that the spacer is in position and the spacer handling tool is used to close the pin or open the pin.

A jack may be included within the system of the present invention to raise the polished rod for insertion or the removal of one or more spacers.

BRIEF DESCRIPTION OF THE INVENTION

Figure 1:
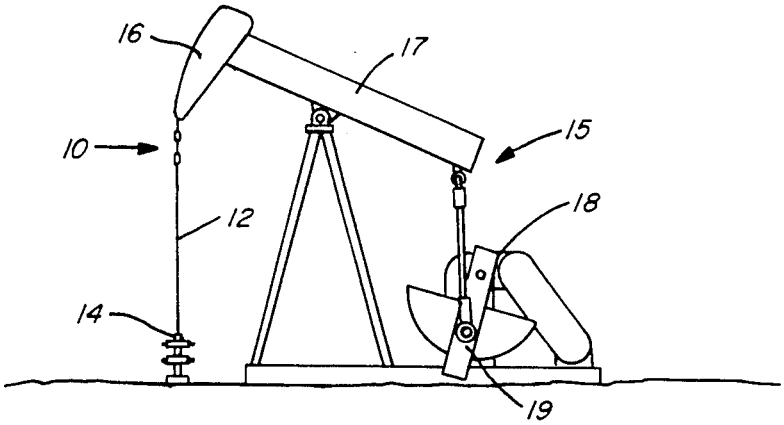
FIG. 1 discloses the environment for the polished rod spacer and jack system which inserts or removes a spacer to change the stroke of the polished rod of a sub-surface oil well pump.

Referring now to FIG. 1, the polished rod spacer system 10 is shown in the environment in which it is used. The spacer system 10 is used in association with a polished rod 12 which passes through a stuffing box 14 into an oil well. The polished rod 12 is attached to a line or string of sucker rods (not shown) in the well, which in turn is attached to a sub-surface pump located below the fluid level of the well to pump the fluids up to the surface. The pump is a reciprocating pump and requires the polished rod 12 to be raised and lowered to provide the reciprocating pumping action. The reciprocating action is accomplished with a pumping unit 15. The pumping unit 15 consists of a horse head 16 and a walking beam 17 and a rotating means such as an electric motor or the like for rotating the arm 19 which in turn makes the horses head 16 go up and down. The well head unit 15 is well known to those skilled in the art. The spacer system 10 of the present invention is utilized with those pumping units 15 where the distance from the ground to just below the horses head 16 is anywhere from eight to thirty feet in height. In these well head apparatus making changes at the point of connection of the bridal block which extends from the horse head 16 to the upper polished rod clamp which is attached to polished rod 12 becomes a significant problem. Unless there is equipment that can safely take a person from the ground to a position near the horse head 16, any attempt to change the position of the connection to the polished rod can be very dangerous. With the polished rod spacer system 10 of the present invention which comprises a spacer 20, a jack 40 and a spacer handling tool 60, a change can be accomplished very easily by a person on the ground.

Figure 2:
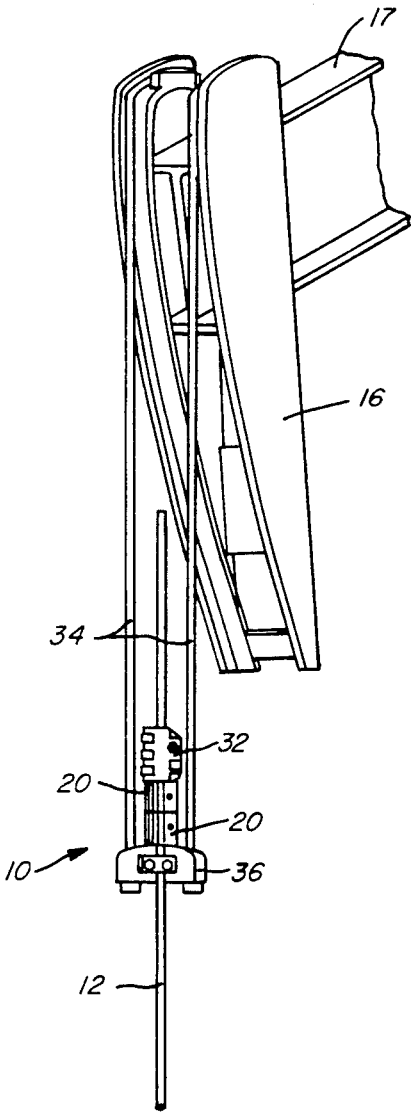
FIG. 2 shows the details of two spacers of the present invention between the bridal block of the pumping unit and the upper polished rod clamp which connects the oscillating horse head for operating the pump in the well.

Referring now to FIG. 2, spacer 20, which is the essential part of the polished rod spacer system 10, is shown in the position that the spacers are used. As shown there are two spacers 20. The pumping unit 15 has a horse head 16 which is attached to one end of a walking beam 17 and further has a pair of cables 34 which are attached to a bridal block 36. At the upper portion of polished rod 12 is an upper polished rod clamp 32 which is securely fastened to the polished rod 12. The spacer(s) 20 is inserted between the bridle block 36 and the upper polished rod clamp 32. As shown in FIG. 2, the pumping unit 15 is in its normal operating position so that when the horse head 16 is raised it will pull up the polished rod 12 by raising the bridle block 36 and the spacer 20 which is in contact with the upper polished rod clamp 32 and conversely as the horse head 16 is lowered the polished rod 12 will be lowered. This raising and lowering of the polished rod 12 extends through the sucker rods in the well to the pump located near the bottom of the well. The use of the spacers 20 is to overcome one of the most significant problems associated with the sub-surface pump. The pump becomes clogged due to the accumulation within the pump of sand or debris which usually plugs the valves of the pump. Additionally, gas bubbles form at the lower portion of the pump which preclude entry of fluid into the pump. So as not to have to remove the sucker rod string and the pump from the well for cleaning and adjustment, an operation known as "tagging bottom" is carried out which jars the pump so as to dislodge the debris or sand as well as the gas bubbles. To do this the polished rod must be lowered for the pump to "bottom out" or hit the bottom to obtain the jarring action. In accordance with the present invention this is done with a polished rod spacer system 10 as will be set forth in more detail hereinafter. Most significantly, the insertion or removal of the spacer 20 of the present invention can be carried out by a person on the ground.

The preferred polished rod spacer system 10 also includes a jack 40. To position the jack 40, the horse head 16 of the pumping device 15 may be either in the up position or the down position. The brake of the pumping unit 15 is applied and the polished rod 12 is held stationary. If there is no brake on the pumping device 15, the polished rod 12 is sometimes more easily held stationary when the horse head 16 is in the fully up position rather than the fully down position. On the other hand with a good brake on the pumping device 15, it is preferred that the horse head 16 be in the substantially fully down position for attaching the jack 40. As shown in FIG. 1, a stuffing box 14 is at the top of the christmas tree which is above ground level. The jack 40 is positioned on the top of the stuffing box 14 between the stuffing box 14 and a lower polished rod clamp 42. The lower polished rod clamp 42 is secured to the polished rod 12 so that the jack 40 will lift the polished rod 12 when the hydraulic system of the jack 40 is activated. The jack 40 is constructed of individual elements each of which may be easily handled by a single person. The first element positioned is a lower mounting bracket 44. The mounting bracket 44 is preferably made of two pieces each symmetrical so that the pieces are easily handled. A preferred construction has two symmetrical pieces, each piece having a thin portion which extends from a thick portion and have opening so that the two pieces may be bolted to one another while surrounding the polished rod 12. In other words, if the piece viewed in FIG. 3 has the thick portion on the left of the polished rod and the thin piece to right, then the thin portion is bolted to the thick portion of the reciprocal or back side member. In each member of the mounting bracket 44 is a drilled opening 46 into which a pin may be inserted. Each hydraulic cylinder 48 has a pin in the base so it may be set in place with the pin in the opening 46 of the lower mounting bracket 44. Similarly, each cylinder head 50 has a pin. The upper mounting bracket 54, which may be identical in construction to the lower mounting bracket 44, is easily put in place by placing one element on the cylinder head 50 so that the pin is inserted into opening 56 in the upper mounting bracket 54 and then the other element. The elements of either the lower mounting bracket 44 or the upper mounting bracket 54 are bolted together by bolts 47 and 57, respectively. The hydraulic system of the jack 40 can then be activated which raises the cylinder head 50 of each cylinder and raises the polished rod 12 in respect to the bridle block 36 which is not moving. The jack 40 is used therefore to either permit the insertion or removal of one or more spacers 20.

Figure 4:
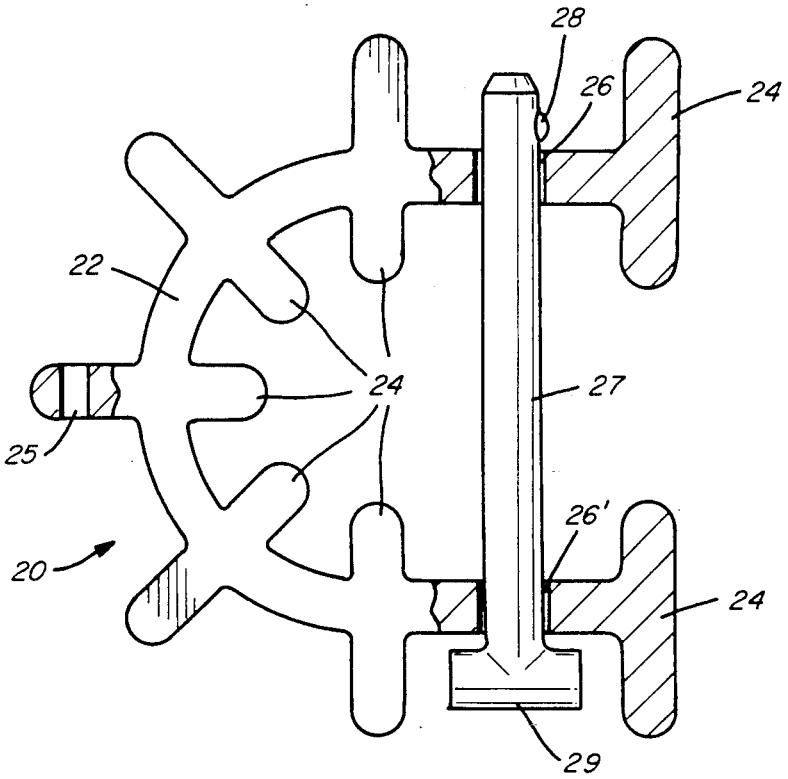
FIG. 4 is a top view of a spacer of the present invention in cross-section in part to show the opening for carrying the spacer into position and the detent pin used in the preferred embodiment of the spacer of the present invention.
Figure 5:
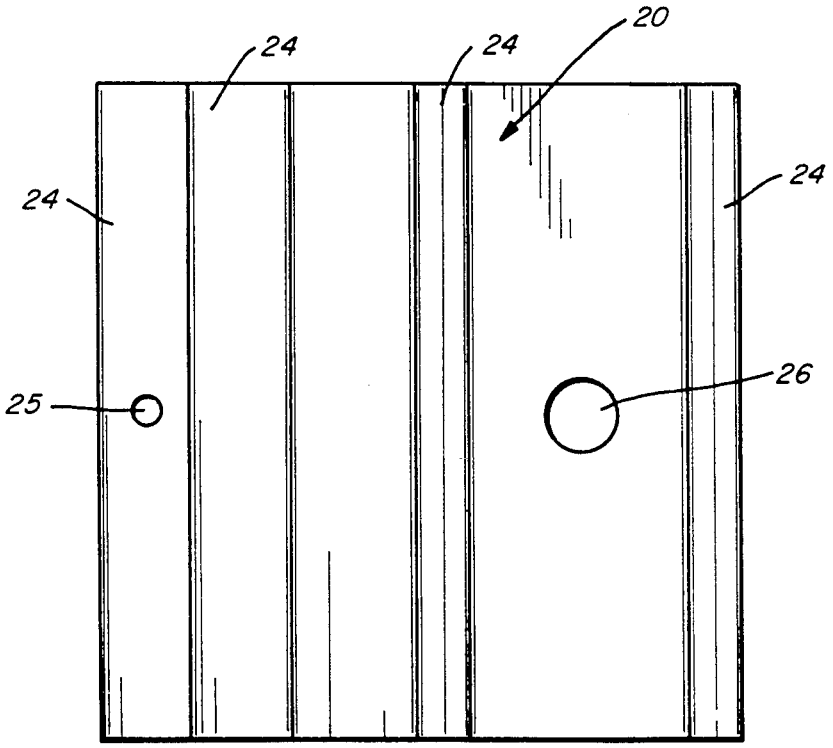
FIG. 5 is a side view of a spacer of the present invention.

Referring now to FIG. 4 and FIG. 5 which shows the preferred construction of a spacer 20. Spacer 20 has a U-shaped body 22 which has a plurality of splines 24. As shown in FIG. 4, the preferred spacer 20 has a spline 24 positioned at the mid point of the U-shaped body and at the termination of the body 22. In addition there are four other splines 24, each of which together with the mid point spline have their inner tips form an inner radius. For a spacer 20 with an inner diameter of $1\frac{3}{8}''$, the spacer 20 is then suitable for use with either $1\frac{1}{8}''$ or $1\frac{1}{4}''$ diameter polished rods which are the most commonly used. A spacer 20 may have a larger inner radius or smaller radius, for example, a diameter of 1.8" is used with polished rods of $1\frac{1}{2}''$ or $1\frac{1}{4}''$ diameter. The body 22 or spline 24 width, as viewed in FIG. 4, is 5/16" when the inner diameter is $1\frac{3}{8}''$ and is $\frac{3}{8}''$ when the inner diameter is 1.8". The spacer is preferably made from an aluminum alloy because of the light weight. Such an aluminum alloy is known as 6061T6 and has a tensile strength of about 38,000 pounds. The use of the splines 24 provides a bearing surface of about four times the surface of the U-shaped body alone but does not require the weight or the amount of material of construction of a solid body having the same bearing surface. The spacer 20 has an opening 25 in the mid point spline 24 in that portion of the spline 24 outside the U-shaped body 22 which is used to insert or remove the spacer 20 from above the bridle block 36. The spacer 20 also has openings 26 and 26' aligned across from each other in the U-shaped body 22. A detent pin 27 may be inserted into the openings 26. The detent pin 27 has a raised portion 28 near one end of the pin 27 and a tubular member 29 at the other end of the pin 27 for purposes which will be described in more detail hereinafter.

Figure 3:
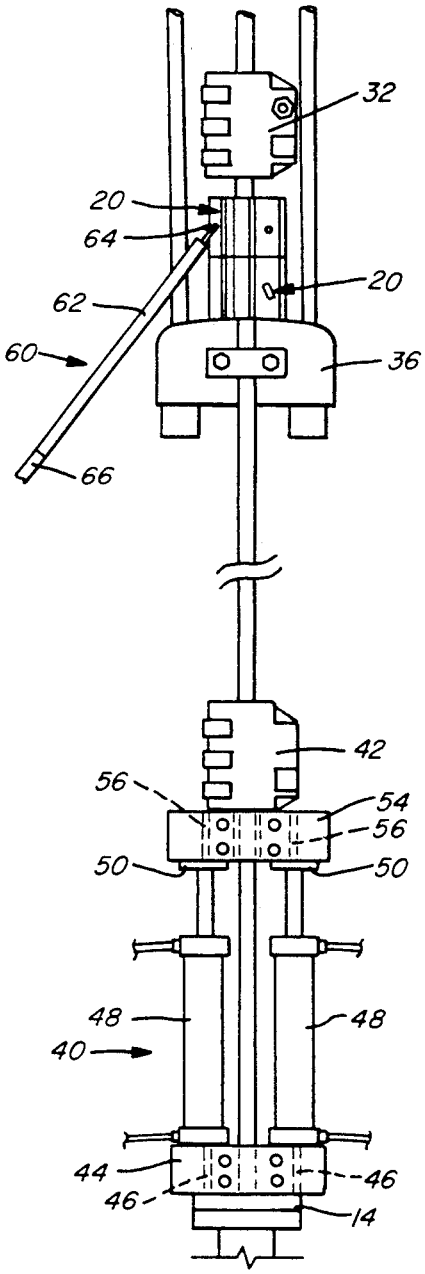
FIG. 3 discloses the jack used for the insertion or removal of a spacer and the hand held spacer handling tool by a person standing on the ground.

FIG. 3 also shows a portion of the spacer handling tool or extendable wand 60. This handling tool 60 has an upper section 62 that has a three prong end 64. The longest prong extends directly from upper sections 62 and has the same axis. The other two prongs are a u-shaped piece welded to the first prong so that the two prongs extend at right angles. The prong extending at right angles and nearest the end 64 is adapted to be inserted into opening 25 of midpoint spline 24 while the second prong will rest against the outside surface of midpoint spline 24 to provide stability for carrying the spacer 20 from or to the ground. The prong which extends directly from upper section 62 is used to close or open the detent pin 27 by insertion into the end 29 of the detent pin 27. The tool 60 is constructed of a plurality of sections 66, each of which may be two to four feet long. In inserting a spacer 20, the prong of the upper section 62 is inserted into opening 25 of the spacer and the spacer is placed in contact with the polished rod 12. The detent pin 27 is open, that is the restraint 28 is holding pin 27 in opening 26'. The spacer 20 is raised up the polished rod 12 until another section 66 of the handling tool 60 needs to be added. As the sections 66 are added the spacer 20 is raised to just below the bridle block 36. The spacer 20 is then position by the spacer handling tool 60 above the bridle block 36 and below the upper polished rod clamp 32. If more than one spacer 20 is positioned then the procedure is repeated. As each spacer 20 is positioned, the handling tool is used to close the detent pin 27 which assures that the spacer is completely surrounding the polished rod 12 and will not fall when the pumping device 15 is reactivated. The removal of a spacer 20 is the reverse of the procedure. The height or side view dimension as shown in FIG. 5 of a spacer 20 may be from 1" to 12", with the 4" height spacer 20 being a standard size. This 4" spacer 20 weighs less than two pounds and therefore can be easily raised into position by a single person on the ground.

The polished rod spacer and jack system 10 of the present invention has been described in detail. The system 10 is usually used when the upper polished rod clamp 32 has been securely positioned on the polished rod 12 to be able to jar the sub surface pump or the procedure referred to as "tagging bottom". The polished rod 12 is then raised and one or more spacers 20 are positioned above the bridle block 36 so that when the polished rod 12 is raised and lowered that the fluid in the well is pumped to the surface. The whole operation of setting up the jack 40 and removal of a spacer 20 can be done with equipment which can be placed in the back of a stationwagon or trunk of a sedan since none of the elements of equipment of the system 10 are more than two to four feet long and none are so heavy that a single person can not easily lift and place them into operation. When necessary the procedure of "tagging bottom" is carried out and a spacer 20 or more than one spacer is removed and after jarring the debris loose then the spacer 20 is repositioned for further pumping.

It is to be understood that various modifications may be made. For example, one or more spacers 20 may be used above the upper mounting bracket 56 to contact the lower polished rod clamp 42 or a spacer 20 may be between the bridle block 36 and the upper polished rod clamp 32 even in the "tagging bottom" position. Other modifications are all considered within the present invention.

I claim:

1. A spacer for changing the stroke of a polished rod of a sub-surface oil well pump which comprises:

a U-shaped body composed of two spaced segments connected by a connecting segment, said U-shaped body having a plurality of splines projecting inside and outside said U-shaped body;

tips of said inside projecting splines on said connecting segment terminating at the perimeter of a circle having a first radius; and one of said splines located at a mid-point around the length of said U-shaped body, said mid-point spline having an aperture in its outside projection.

2. A spacer according to claim 1 wherein there are five splines on said connecting segment having said tips terminating at the perimeter of said circle.

3. A spacer according to claim 2 wherein there are two splines at the termination of the U-shaped body.

4. A spacer according to claim 1 wherein the spacer body has a height of 4" and the inner diameter is $1\frac{3}{8}$".

5. A spacer according to claim 1 wherein the spacer is made of an aluminum alloy.

6. A spacer according to claim 1 wherein the U-shaped body has aligned openings for a detent pin.

7. A spacer according to claim 1 which further includes a detent pin having a tubular member at one end of the pin.

8. A spacer according to claim 1 wherein said U-shaped body has a height from one to twelve inches and the first diameter is greater than an outer diameter of the polished rod.

9. A spacer for changing the stroke of a polished rod of a sub-surface oil well pump which comprises:

a generally U-shaped body having an aperture adapted for inserting or removing the spacer from around the polished rod, and said U-shaped body having two aligned openings for a detent pin; and said U-shaped body having integral means for providing at least two spaced apart load bearing surfaces.

10. The spacer according to claim 9 wherein said detent pin includes a tubular member at one end of said pin.

11. The spacer according to claim 9 wherein said means integral with said U-shaped body includes a plurality of splines, one of said splines located at a mid-point around the length of said U-shaped body and at least two other splines, tips of said splines terminating at the boundary of a circle having a first radius.

12. A spacer for changing the stroke of a polished rod of a sub-surface oil well pump which comprises:

a generally U-shaped body having an inner radius which is greater than an outer radius of the polished rod, said U-shaped body having means adapted for inserting and removing the spacer from around the polished rod;

a detent pin received in aligned openings in said U-shaped body, and said detent pin having a tubular member at one end of said pin; and said U-shaped body having a plurality of splines extending between and providing at least two spaced apart load bearing surfaces.

* * * * *